US005095877A

United States Patent [19]

Kikuchi et al.

[11] Patent Number: 5,095,877

[45] Date of Patent: Mar. 17, 1992

[54] FUEL INJECTION CONTROL APPARATUS HAVING ATMOSPHERIC PRESSURE CORRECTION FUNCTION

[75] Inventors: Toshiaki Kikuchi, Okazaki; Kazunori Kishita; Masakazu Ninomiya, both of Kariya; Jun Ozeki, Nagoya, all of Japan

[73] Assignee: Nippondenso Co., Ltd., Kariya, Japan

[21] Appl. No.: 614,453

[22] Filed: Nov. 16, 1990

[30] Foreign Application Priority Data

Nov. 17, 1989 [JP] Japan ..... 1-300036

[51] Int. Cl.[5] ..... F02D 41/10

[52] U.S. Cl. ..... 123/492; 123/493

[58] Field of Search ..... 123/492, 493, 478, 488, 123/494

[56] References Cited

U.S. PATENT DOCUMENTS 4,884,548 12/1989 Sogawa ..... 123/492

FOREIGN PATENT DOCUMENTS 57-198343 12/1982 Japan ..... 123/492

59-165850 9/1984 Japan ..... 123/492

64-6333 2/1989 Japan ..... 123/492

*Primary Examiner*—Raymond A. Nelli

*Attorney, Agent, or Firm*—Cushman, Darby & Cushman

[57] ABSTRACT

An apparatus for controlling a quantity of fuel injected into an internal combustion engine comprises a sensor for detecting atomspheric pressure, a sensor for detecting a load condition of an internal combustion engine, and an electronic control device including a microprocessor. The CPU functions to perform the processing steps including: step of setting a reference fuel injection quantity in accordance with a load condition of the engine, step of detecting a transient condition of the engine, step of setting a transient correction value in accordance with the transient condition of the engine, step of correcting the transient correction value to be decreased as the atmospheric pressure decreases, and step of setting a quantity of injection fuel supplied to the engine in accordance with the set value of the reference fuel injection quantity and the corrected transient correction value, whereby a deviation of an air fuel ratio from an appropriate value can be prevented even under a transient condition where atmospheric pressure varies.

10 Claims, 11 Drawing Sheets

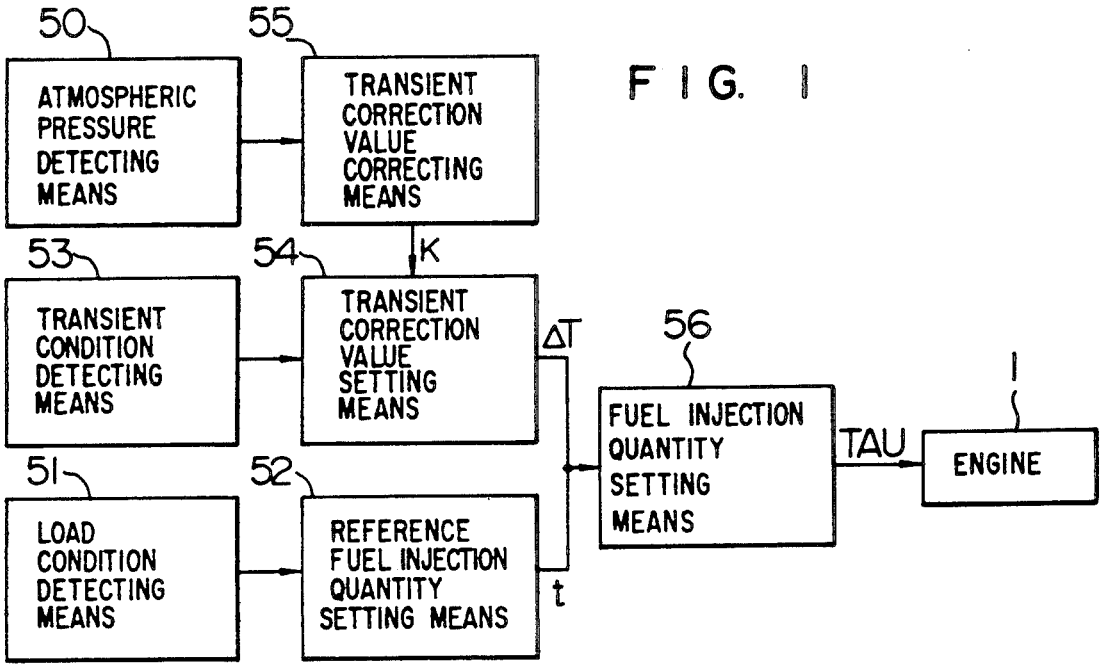
FIG. 1
FIG. 5
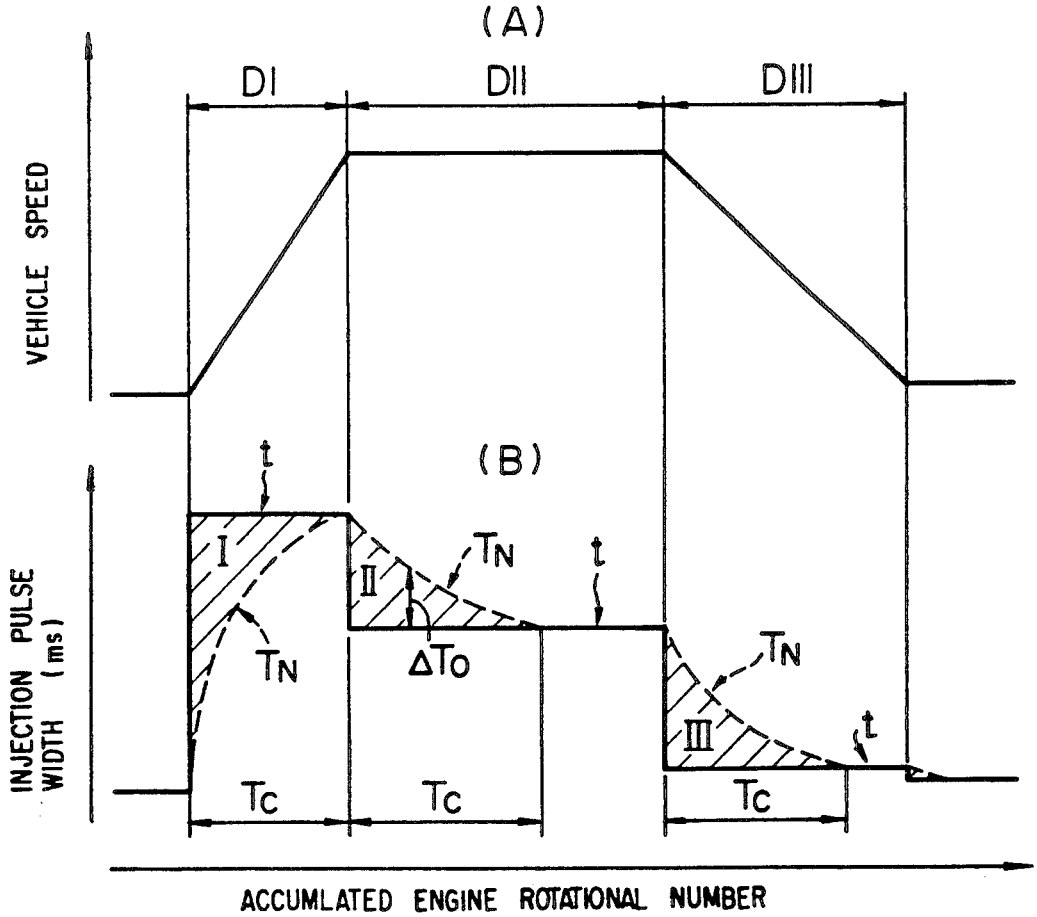

FUEL INJECTION CONTROL APPARATUS HAVING ATMOSPHERIC PRESSURE CORRECTION FUNCTION

BACKGROUND OF THE INVENTION

1. Field of the Invention

The present invention relates to an apparatus for controlling a fuel injection quantity supplied to an engine, and in particular for making a load correction of the fuel injection quantity at a transient time.

2. Description of the Related Art

An air fuel ratio differs between normal and transient driving conditions due to a fact that mutual relation between a quantity of fuel deposited on the inner wall of an intake manifold and an evaporation quantity of fuel deposited thereon varies. In order to prevent this deviation of the air fuel ratio, an apparatus for controlling a fuel injection quantity for an internal combustion engine has been proposed which corrects a reference fuel injection quantity set based on a quantity of intake air sucked into an internal combustion engine by using a transient correction value to be set in response to each transient condition of the engine (for example, JP-B-64-6333).

In a mass flow type apparatus for controlling a quantity of fuel injection into an internal combustion engine, an intake air quantity is detected by means of an air flow meter and the like and a reference fuel injection quantity is set depending upon the detected intake air quantity. With such a type of apparatus, the reference fuel injection quantity becomes excessive, because air density decreases at a higher altitude place as compared with a lower altitude place. In order to prevent such a deviation of an air fuel ratio, an atmosphere correction system for decreasing the reference fuel injection quantity with a decrease in the atmospheric pressure has been proposed.

In a speed density type system for controlling a fuel injection quantity of an internal combustion engine, intake air pressure in an intake pipe downstream of a throttle valve is detected by using a pressure sensor and thereby an intake air quantity is determined indirectly from the detected intake pipe pressure, and then a reference fuel injection quantity is set depending upon the determined intake air quantity. With such a speed density type system, since atmospheric pressure becomes lower at a higher altitude place as compared with a lower altitude place and accordingly the intake air quantity is increased at a higher altitude place even with the same intake pipe pressure, the reference fuel injection quantity becomes too small at a higher altitude place. In order to prevent such a deviation of an air fuel ratio, an atmosphere correction system, which increases and corrects the reference fuel injection quantity with a decrease in atmospheric pressure, has been proposed.

According to the inventors' experiments using various internal combustion engines, it has been found that the above-mentioned mutual relation between the deposition and evaporation of fuel in an intake manifold varies depending not only on a transient condition but also on atmospheric pressure. More precisely, it has been found that a quantity of fuel deposited on an intake manifold decreases with a decrease in atmospheric pressure even under the same transient condition. Therefore, there is a problem that air fuel mixture becomes richer so that exhaust emission is deteriorated under lower atmospheric pressure, if a reference fuel injection quantity is corrected with a transient correction value set based only on transient conditions, as is done in the above mentioned apparatuses.

Further, the atmosphere correction in the fuel injection quantity control apparatuses for an internal combustion engine of the mass flow type and of the speed density type aims to correct an error of a detected intake air quantity. Even with such atmosphere correction, it is not possible to correct the deviation of an air fuel ratio due to the fact that the mutual relation between the deposition and evaporation of fuel in an intake manifold varies also with a change of atmospheric pressure, even if such an atmosphere correction is carried out.

SUMMARY OF THE INVENTION

The present invention was made in order to solve the above mentioned problems.

It is an object of the present invention to provide a fuel injection quantity control apparatus for an internal combustion engine which can appropriately correct a deviation of an air fuel ratio under transient conditions even if atmospheric pressure changes, to thereby prevent exhaust emission from being deteriorated.

In order to accomplish the above mentioned object, as shown in FIG. 1, the present invention provides a fuel injection quantity control apparatus for controlling a quantity of fuel injected into an internal combustion engine, comprising means 60 for detecting atmospheric pressure, means 51 for detecting a load condition of an internal combustion engine 1, means 52 for setting a reference fuel injection quantity (t) in accordance with the load condition of the engine 1, means 53 for detecting a transient condition of said engine 1, means 54 for setting a transient correction value $\Delta T$ in accordance with the transient conditions of the engine 1, transient correction value correcting means 55 for correcting the transient correction value $\Delta T$ to be decreased as the atmospheric pressure decreases, and means 56 for setting a quantity of injection fuel TAU supplied to said engine 1 in accordance with the set value of the reference fuel injection quantity (t) and the corrected transient correction value $\Delta T$.

As to the transient condition detecting means 53, the transient correction value setting means 54 and the transient correction value correcting means 55, means for setting a filter value in accordance with an operation condition of the engine 1 and filtering means for filtering the reference fuel injection quantity (t) by using the filter value to detect a filtering function value may be used, and furthermore, means 54 for setting the transient correction value $\Delta T$ in accordance with a deviation between the reference fuel injection quantity (t) and the filtering function value may be used, and next, means 55 for correcting the set transient correction value $\Delta T$ in accordance with the operating condition of the engine 1 may be used.

In accordance with the fuel injection quantity control apparatus of the present invention, the reference fuel injection quantity (t) is set by the reference fuel injection quantity setting means 52 in accordance with a load condition of the engine 1 detected by the load condition detecting means 51. The transient correction value (K) is set by the transient correction value correcting means 55 in accordance with the atmospheric pressure PA detected by the atmospheric pressure detecting means 50.

The transient correction value (ΔT) is then set by the transient correction value setting means 54 in accordance with a transient operating condition of the engine 1 detected by the transient condition detecting means 53 and the transient correction value (K).

Finally, the fuel injection quantity (TAU) is set by the fuel injection quantity setting means 56 in accordance with the reference fuel injection quantity (t) and the transient correction value ΔT.

BRIEF DESCRIPTION OF THE DRAWINGS

FIG. 1 is a function block diagram of the present invention;

FIG. 5 is a graph showing the characteristics of the transient reference correction value;

DESCRIPTION OF THE PREFERRED EMBODIMENTS

Figure 2:
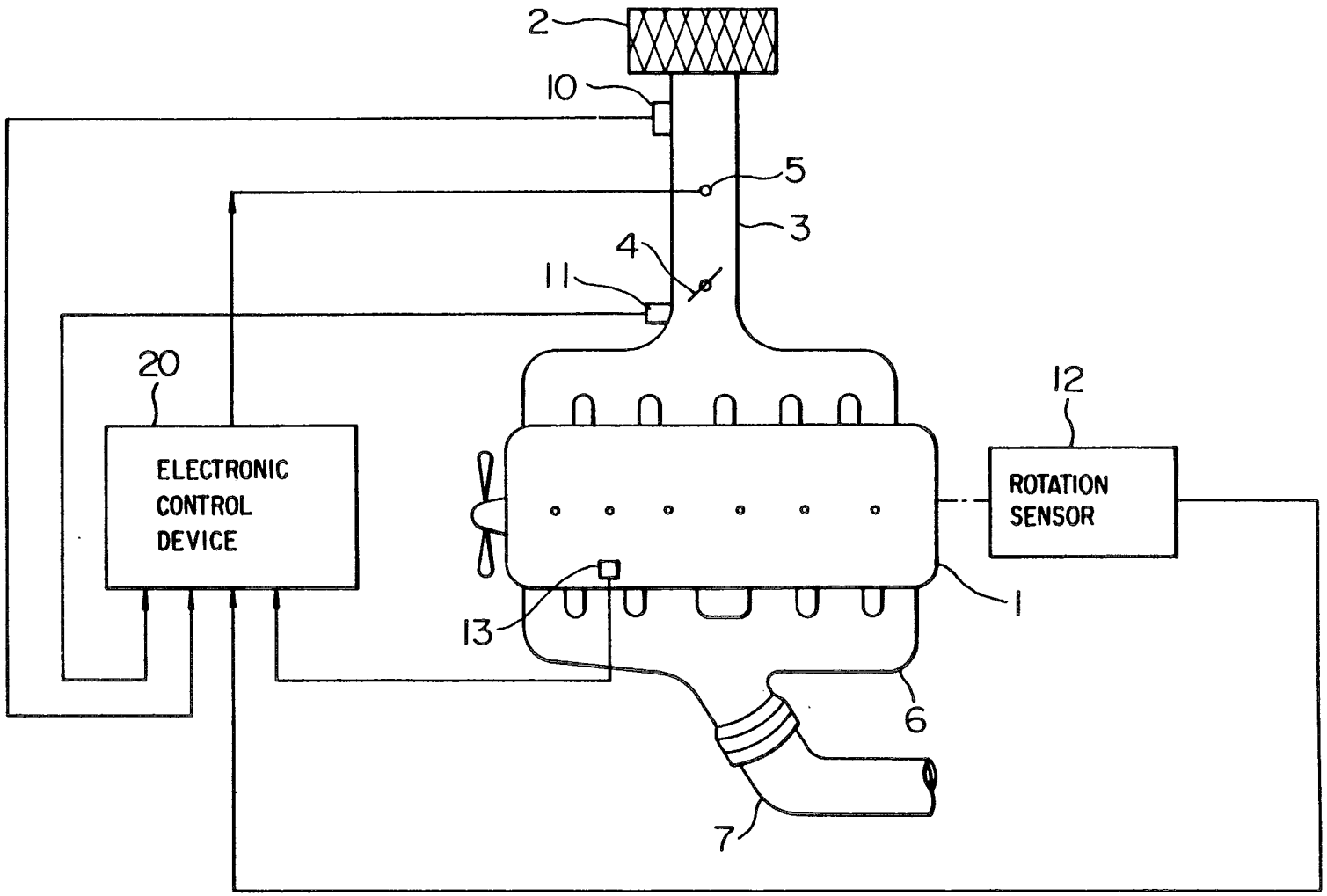
FIGS. 2 and 3 are views showing the schematic structure of an embodiment of the present invention.
Figure 18:
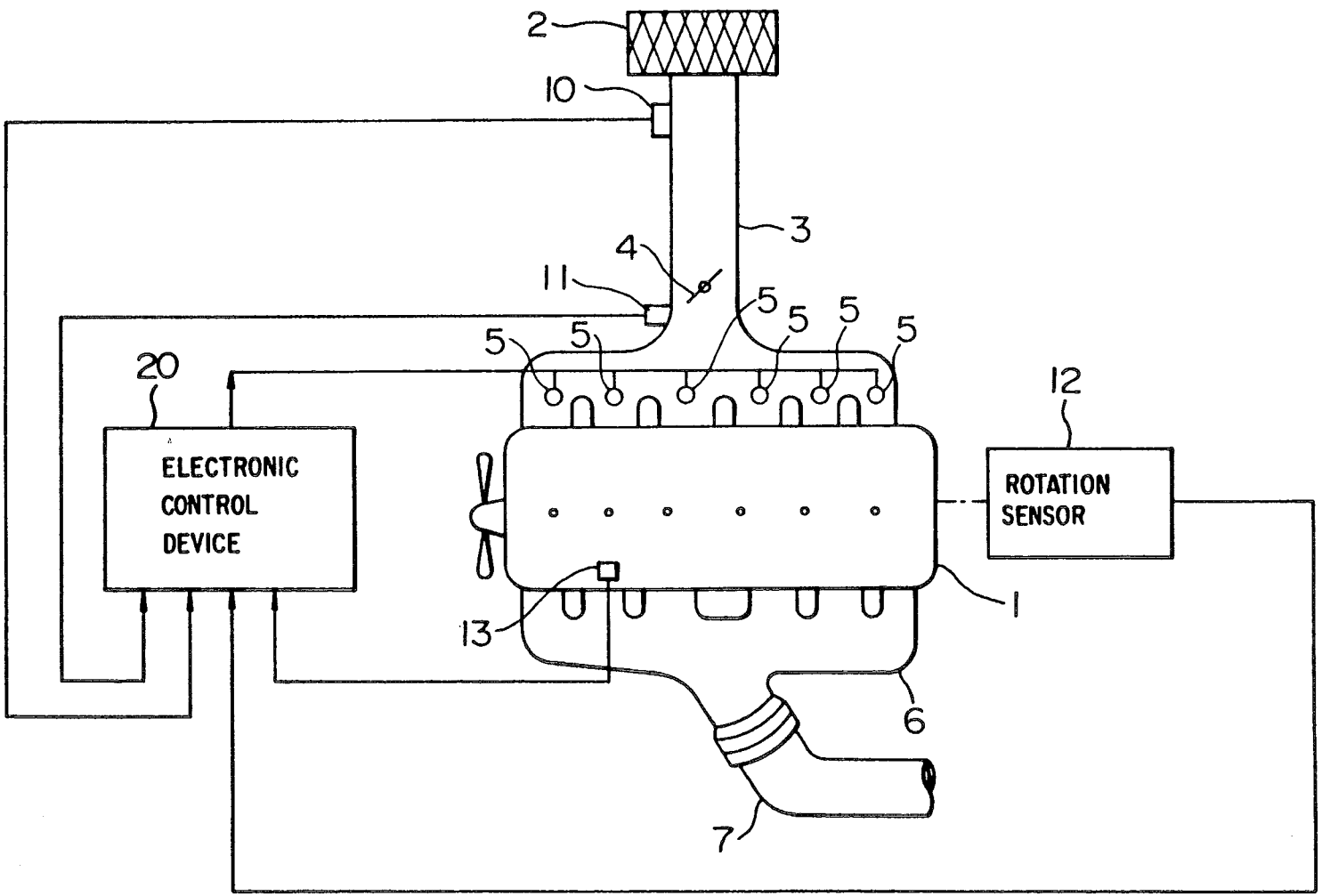
FIG. 18 is a schematic view showing the schematic structure of another embodiment of the present invention in which the present invention is applied to an MPI (multipoint injection) type engine.

The present invention will now be described with reference to an embodiment shown in the drawings. FIG. 2 is a schematic view showing the structure of an engine and an electronic control system for the engine to which the present invention is applied. The engine 1 is, for example, a four stroke cycle spark ignition type engine. Combustion air is admitted to cylinders via an air cleaner 2, an intake pipe 3, and a throttle valve 4. Fuel is supplied to each cylinder via a single common injector 5 from a fuel supply path (not shown). Although the present embodiment is exemplarily described herein with reference to an SPI (single point injection) type engine in which a single common injector 5 is used, the present invention is equally applicable to an MPI (multipoint injection) type engine in which one injector 5 is provided for each cylinder as shown in FIG. 18. After combustion, exhaust gas is released into atmosphere via an exhaust manifold and an exhaust pipe 7. An intake air temperature sensor 10 which detects the temperature of the combustion air THQ (intake air temperature) for outputting an analog voltage corresponding to the intake air temperature (THQ) and an intake air pressure sensor 11 which detects the intake air pressure PM downstream of the throttle valve for outputting an analog voltage corresponding to the intake air pressure PM are disposed on the side of the intake pipe 3.

A thermistor type cooling water temperature sensor 13 which detects the cooling water temperature THW for outputting an analog voltage (an analog detection signal) corresponding to the cooling water temperature THW is disposed on the engine 1. A rotation sensor 12 detects the rotation of a crank shaft of the engine and outputs pulse signals at a frequency corresponding to the engine rotation for determining an engine rotational speed NE. For example, an ignition coil for an ignition device (not shown) may be used as the rotation sensor 12. In this case, it will suffice to use ignition pulse signals from a primary terminal of the ignition coil as the rotation signal. An electronic control device 20 comprises a circuit which calculates the fuel injection quantity, etc. based on the detection signals from various sensors 10 through 13 for adjusting the fuel injection quantity, for example, by controlling the period of time during which a valve of the injector 5 for injecting fuel is opened.

Figure 3:
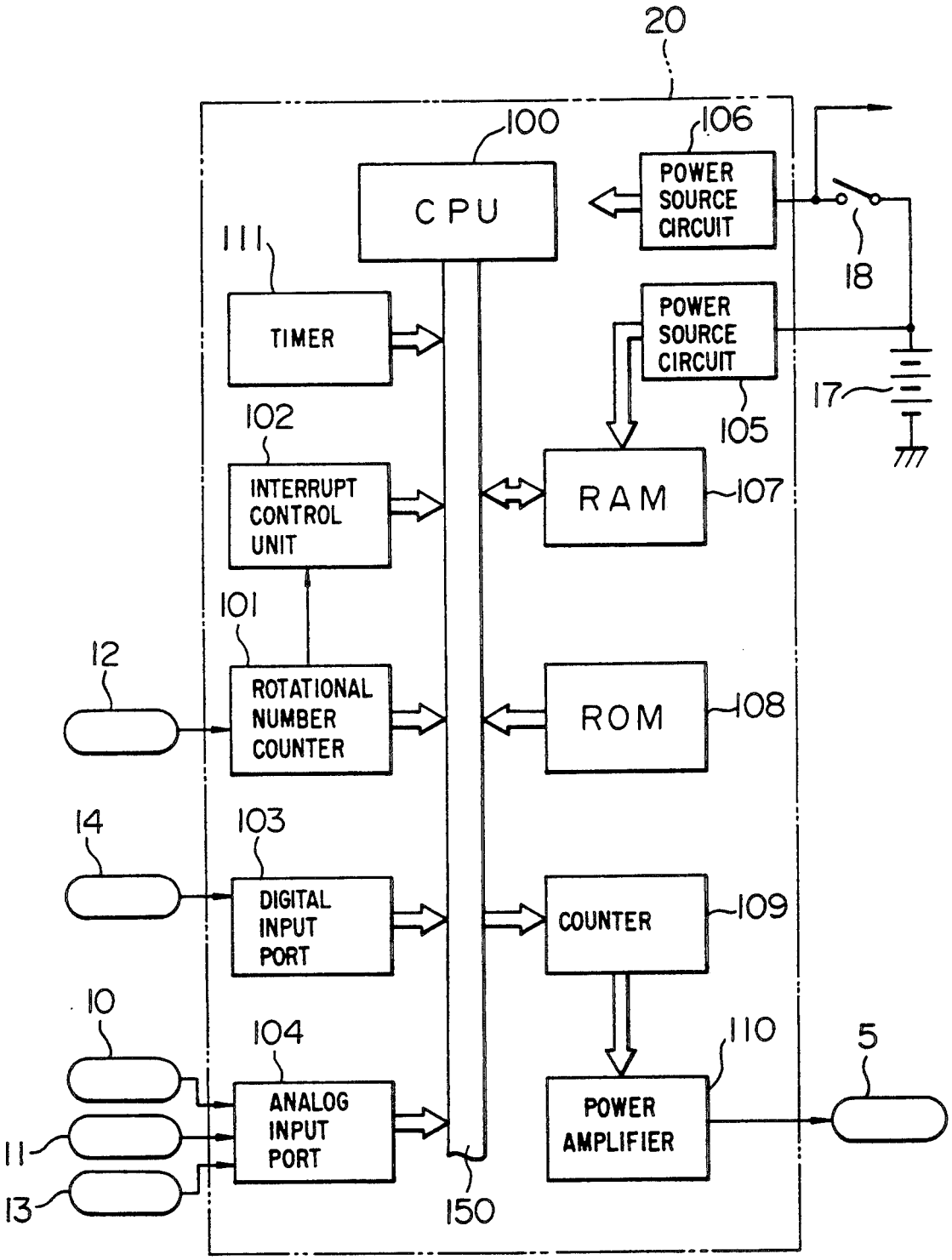

FIG. 3 is a view showing the structure of the electronic control device 20. A reference numeral 100 denotes a microprocessor (CPU) which calculates the fuel injection quantity, etc. Reference numeral 100 denotes a rotational number counter which counts the rotational number of the engine 1 in response to signals from the rotation sensor 12. The rotational number counter 101 feeds an interruption command signal to an interruption control unit 102 in synchronization with the rotation of the engine. When the interruption control unit 102 receives this signal, it outputs an interruption signal to the CPU 100 via a common bus 150. A digital input port 103 transmits to the CPU 100 digital signals such as a starting signal from a starter switch 14 which is turned on or off in response to the operation of a starter (not shown). An analog input port 104 comprising an analog multiplexer and an A/D converter has a function to effect analog-to-digital conversion of respective signals from the intake air temperature sensor 10, the intake air pressure sensor 11 and the cooling water temperature sensor 13 and to make the CPU 100 sequentially read the signals. Output information from each of units 101, 102, 103 and 104 is transmitted to the CPU 100 via the common bus 150. A power source circuit 105 supplies electric power to a memory unit (RAM) 107 which will be described hereafter. The power source circuit 105 is directly connected with a battery 17 bypassing a key switch 18. Accordingly, electric power is constantly supplied to the RAM 107 independently of the key switch 18. Reference numeral 106 denotes a power source circuit which is connected with the battery 17 via the key switch 18. The power source circuit 106 supplies electric power to units other than the RAM 107. The RAM 107 is a temporal memory unit which is temporarily used in the execution of a program. Since, the RAM 107 is always connected with the power source independently of the key switch 18, the contents stored in the RAM 107 will not be erased even if the operation of the engine 1 is stopped. Accordingly, RAM 107 forms an involatile memory. A read-only memory (ROM) stores programs and various constants. A fuel injection time control counter 109 having a register is formed of a down counter. The counter 109 converts a digital signal representative of a valve opening time of the injector 5, that is, the fuel injection quantity calculated by the CPU to a pulse signal having a pulse width (injection pulse width Ti) providing an actual opening time of the valve of the injector 5. Reference numeral 110 denotes a power amplifier which outputs a driving signal for driving the injector 5, and reference numeral 110 denotes a timer for measuring elapsed time to transmit it to the CPU 100.

Now, the setting of the fuel injection quantity (ATU) will be described with reference to a flow chart shown in FIG. 4. The engine rotational number from the rotational number counter 101 is read in response to the rotation interruption signal from the interrupt control unit 102 and the engine rotational speed NE is obtained therefrom at step 1000. The intake air pressure PM is read through the analog input port 104 at step 1001. A reference fuel injection quantity (that is, a reference fuel injection pulse width t of the injector 5), which is determined by the engine rotational speed NE obtained at step 1000 and the intake air pressure PM read at step 1001, is calculated at step 1002 in accordance with a calculation formula as follows:

$$t = f \times NE \text{ (f is a constant)}$$

Then, the cooling water temperature THW is read through the analog input port 104 at step 1003. Similarily, the intake air temperature THQ is read through the analog input port 104 at step 1004.

Steps 1005 through 1017 form a routine for setting a correction value $\Delta T$ at a transient time. This transient correction value $\Delta T$ is set based on a difference (a transient reference correction value $\Delta T_0$) between the reference fuel injection pulse width (t) and a filtering function value $T_N$ which is obtained by filtering the reference fuel injection pulse width (t) in accordance with a formula (1) shown below, as is well known. The relation between the reference fuel injection pulse width (t) and the filtering function value $T_N$ under each operation condition is shown in FIG. 5 in which the abscissa indicates the accumulated engine rotational number. Areas I, II and III (hatched portions) in respective three engine operation periods DI, DII and DIII denote transient reference correction values $\Delta T_0$. $T_c$ denotes correction periods. The filtering function value $T_N$ is obtained by filtering the reference fuel injection pulse width (t) in accordance with the formula as follows:

$$T_N = \{T_{N-1} \times (N_T - 1) + t\}/N_T \quad (1)$$

wherein $T_{N-1}$ represents a filtering function value at preceding control timing, $N_T$ represents a filter value which is a given value such as 1.5 to 2.0. If $N_T = 2$, an average value of $T_{N-1}$ and (t) is determined. An initial filtering function value $T_0$ is zero.

Steps 1005 through 1009 form a routine for setting the filter value $N_T$. There is a relation between the filter value $N_T$ and the correction period $T_C$ such that the more the filter value $N_T$ becomes, the longer the correction period $T_c$ becomes. Therefore, the filter value $N_T$ is set so that the correction period $T_c$ corresponds to each engine operating condition (the intake air pressure PM, engine rotational speed NE, cooling water temperature THW, intake air temperature THQ, etc.).

Figure 6:
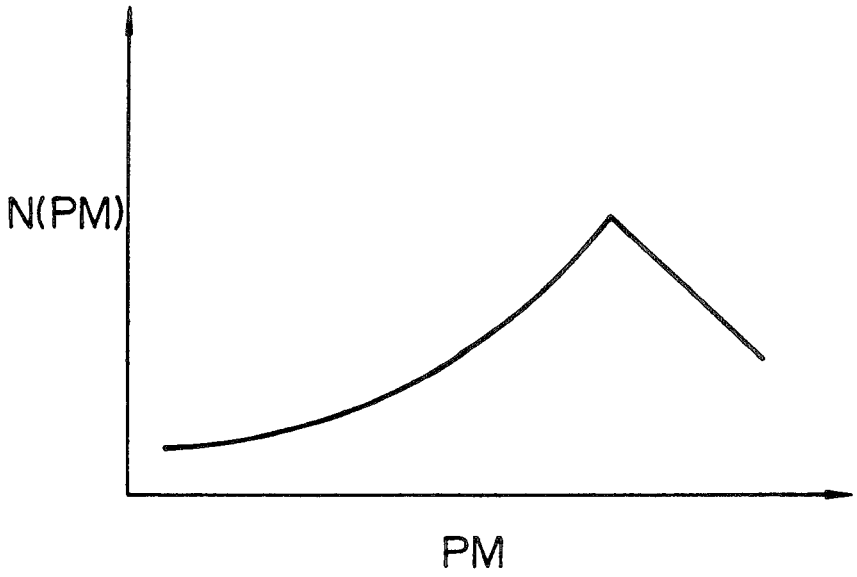
FIGS. 6 through 9 are graphs showing the characteristics of the filter values for respective engine conditions.
Figure 7:
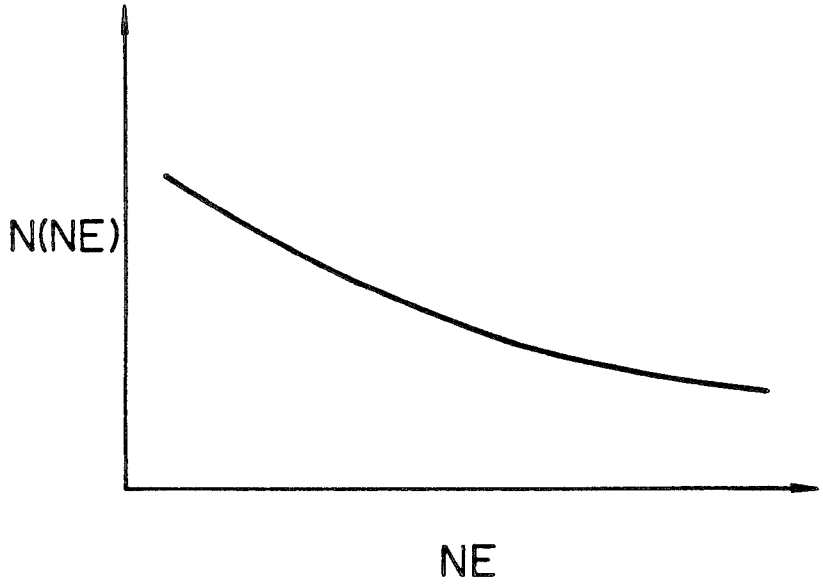

The filter correction value N(PM) corresponding to the intake air pressure PM is read at step 1005. The intake air pressure filter value N(PM) has a characteristic that it increases as the intake air pressure PM increases, as shown in FIG. 6. The intake air pressure filter value N(PM) decreases as the intake air pressure PM increases, as far as the intake air pressure PM is not less than a given value, as this range is shown in FIG. 6. This is due to a fact that a high load increase is applied to the fuel injection quantity TA in this range as will be described later, and accordingly the intake air pressure filter quantity N(PM) is set so that it does not affect the correction period $T_c$. The engine rotational speed filter value N(NE) corresponding to the engine rotational speed NE is read at a subsequent step 1006. The engine rotational speed filter value N(NE) has a characteristic that the engine rotational speed filter value N(NE) decreases as the engine rotational speed NE increases.

Figure 8:
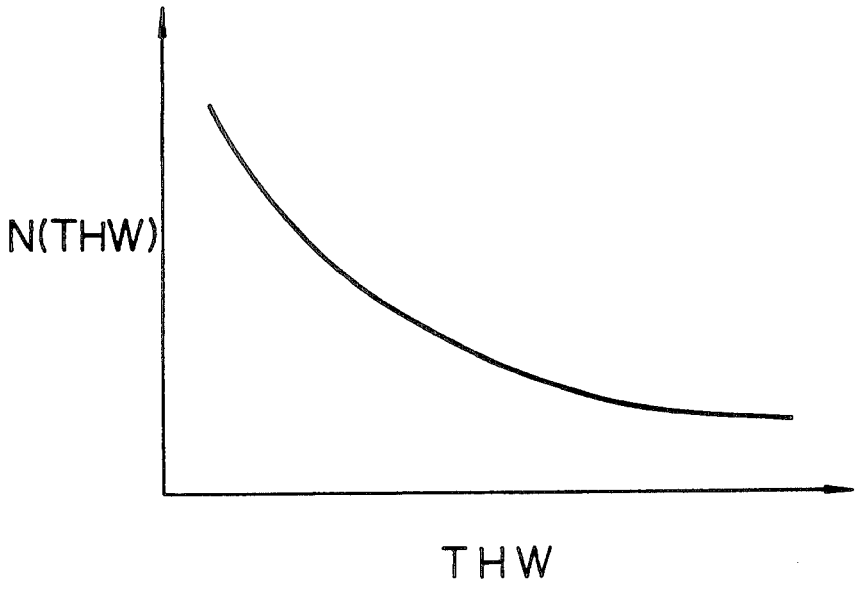
Figure 9:
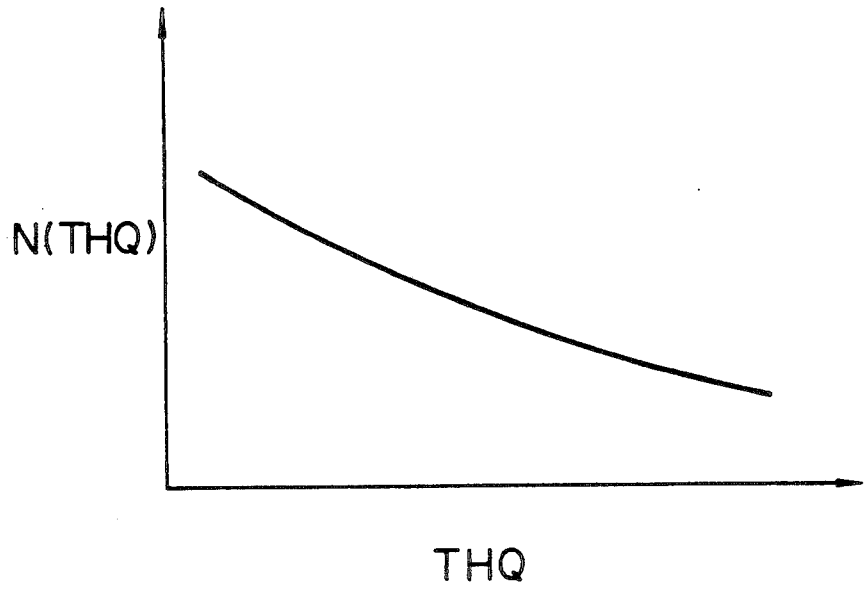

A cooling water temperature filter value N(THW) corresponding to the cooling water temperature THW is read at step 1007. The cooling water temperature filter value N(THW) has a tendency that it decreases as the cooling water temperature THW increases, as shown in FIG. 8. An intake air temperature value N(THQ) corresponding to the intake air temperature THQ is read at step 1008. The intake air temperature filter value N(THQ) has a tendency that it decreases as the intake air temperature THQ increases as shown in FIG. 9.

A filter amount $N_T$ is set in accordance with the following formula at step 1009 based on the filter values N(PM), N(NE), N(THW) and N(THQ) which have been read at the above-mentioned steps 1005 through 1008.

$$NT = N(PM) + N(NE) + N(THW) + N(THQ)$$

The filtering function value $T_N$ is calculated at step 1010. Specifically, the reference fuel injection pulse width (t) is filtered by using the filter value $N_T$, which has been set at step 1009, in accordance with the above-mentioned formula (1) as follows:

$$T_N = \{(N_{T-1}) \times T_{N-1} + t\}/N_T$$

The transient reference correction value $\Delta T_0$ is calculated at subsequent step 1011 as follows:

$$\Delta T_0 = t - T_N$$

Figure 10:
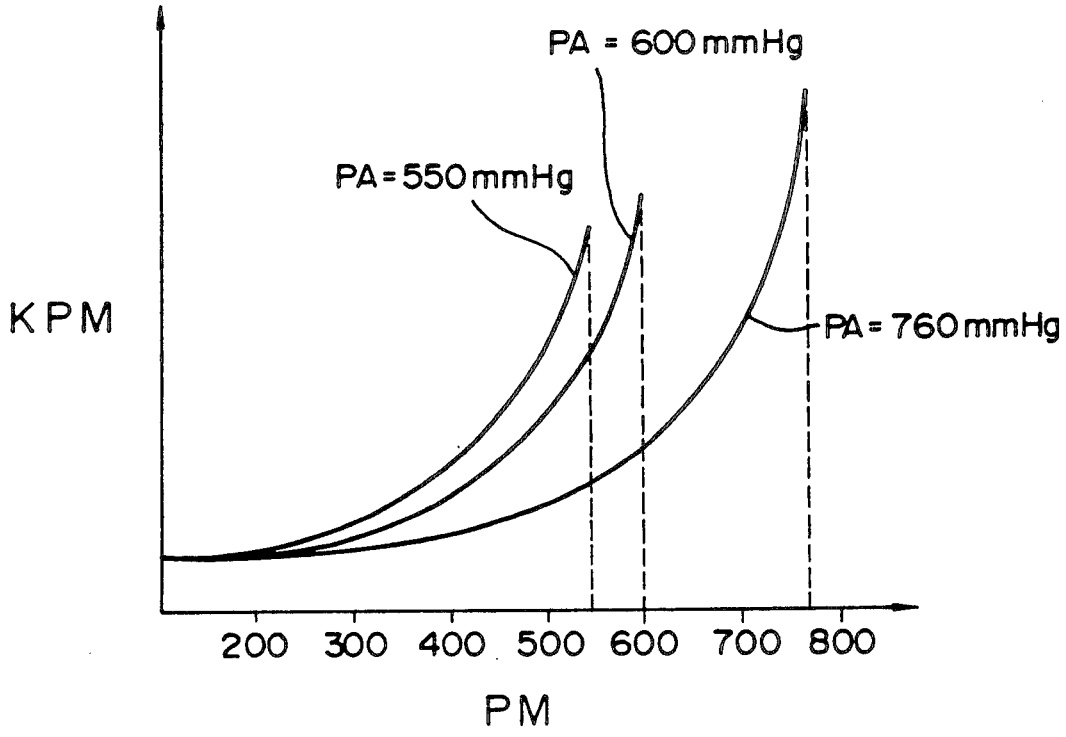
FIGS. 10 through 13, 15 and 17 are graphs showing the characteristics of the transient correction coefficients (K) for respective engine conditions.

Steps 1012 through 1016 form a routine for setting a correction factor (K) for the transient reference correction value $\Delta T_0$ in accordance with the engine conditions. A load correction coefficient KPM corresponding to the intake air pressure PM is determined at step 1012. Since the intake air PM is used in place of the load, the intake air pressure PM differs with a change of the atmospheric pressure PA even if the load condition is the same. Accordingly, the load correction coefficient KPM exhibits a characteristic which is determined by the atmospheric pressure PA and the intake air pressure PM, as shown in FIG. 10. Hence, load correction coefficients KPM are preliminarily stored in the ROM 108 forming a two-dimensional map of the intake air pressure PM and the atmospheric pressure PA and then the coefficients KPM are read from the two-dimensional map. The relation between the intake air pressure PM and the load correction coefficient KPM when the atmospheric pressure is 760, 600 and 550 mmHg, as shown in FIG. 10, is stored in ROM 108 in the present embodiment. The coefficient is calculated from the stored values in the ROM 108 by a known interpolation, if the atmospheric pressure PA assumes intermediate values between 760 and 600 mmHg or between 600 and 550 mmHg. An atmospheric pressure sensor may be provided to detect the atmospheric pressure PA. However, it will suffice to use, as the atmospheric pressure PA, the intake air pressure PM under a high load and a low engine rotational speed condition, since the intake air pressure PM is equal to the atmospheric pressure PA under such a condition, as is well known.

Figure 11:
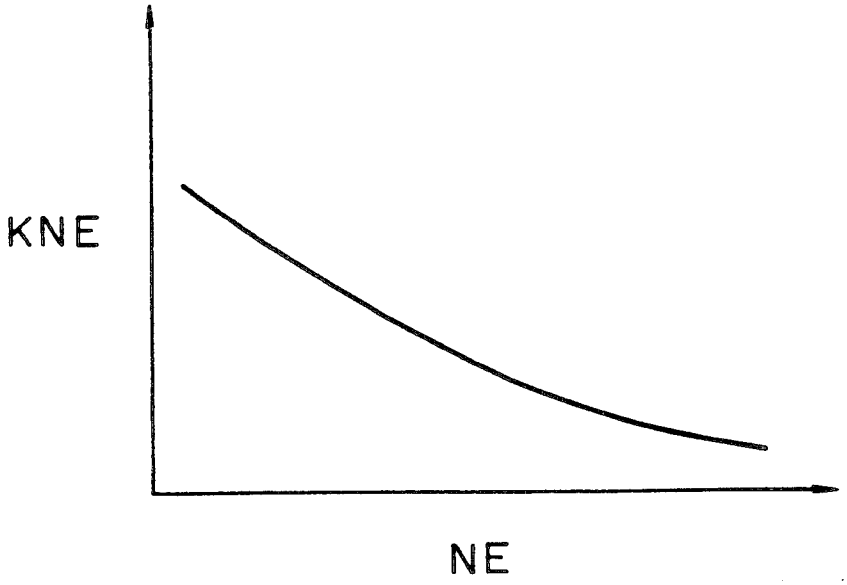
Figure 12:
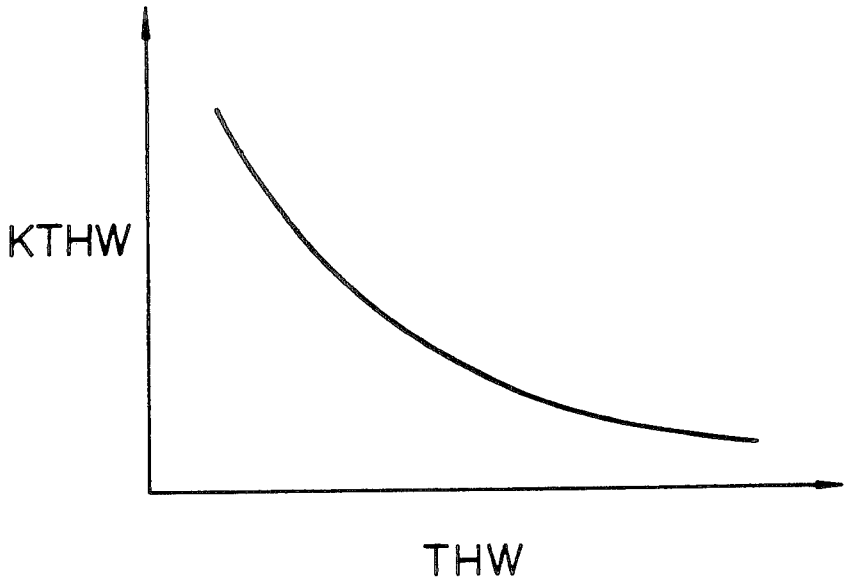
Figure 13:
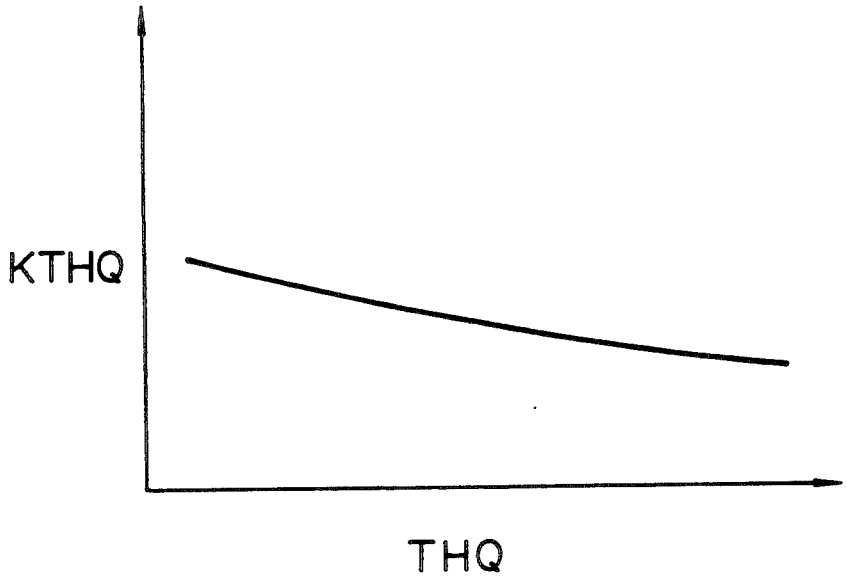

An engine rotational speed correction coefficient KNE corresponding to the engine rotational speed NE is read at next step 1013. The engine rotational speed correction coefficient KNE tends to decrease with an increase in the engine rotational speed NE, as shown in FIG. 11. Then, the cooling water temperature correction coefficient KTHW corresponding to the cooling water temperature THW is read at step 1014. The cooling water temperature correction coefficient KTHW tends to decrease with an increase in the cooling water temperature THW, as shown in FIG. 12. The intake air temperature correction coefficient KTHQ correcponding to the intake air temperature THQ is read at step 1015. The intake air correction coefficient KTHQ tends to decrease with an increase in the intake air temperature THQ, as shown in FIG. 13.

A correction coefficient K is set at subsequent step 1016 by a formula as follows:

$$K=\{1+KPM+KNE+KTHW+KTHQ\}$$

The transient correction value ΔT is set at step 1017 by the following formula:

$$\Delta T=C\times\Delta T_0\times K$$

wherein C is a constant.

A fuel injection quantity TAU is set at step 1018 by the following formula:

$$TAU=t+\Delta T+T'$$

Wherein T' is a correction value other than the transient correction value ΔT.

Digital signals having an injection pulse width Ti corresponding to the fuel injection amount TAU, which has been set as mentioned above, are outputted to the injector 5.

As mentioned above, in the preset embodiment, the load correction coefficient KPM is set in accordance with the intake air pressure PM and the atmospheric pressure PA. Accordingly, the load correction coefficient KPm is set in accordance with the load, even if the atmospheric pressure PA varies. Therefore, fuel is supplied at a rate appropriate to the load even when the atmospheric pressure PA is low. Hence, the controllability of the engine under a transient condition can be enhanced.

Figure 14:
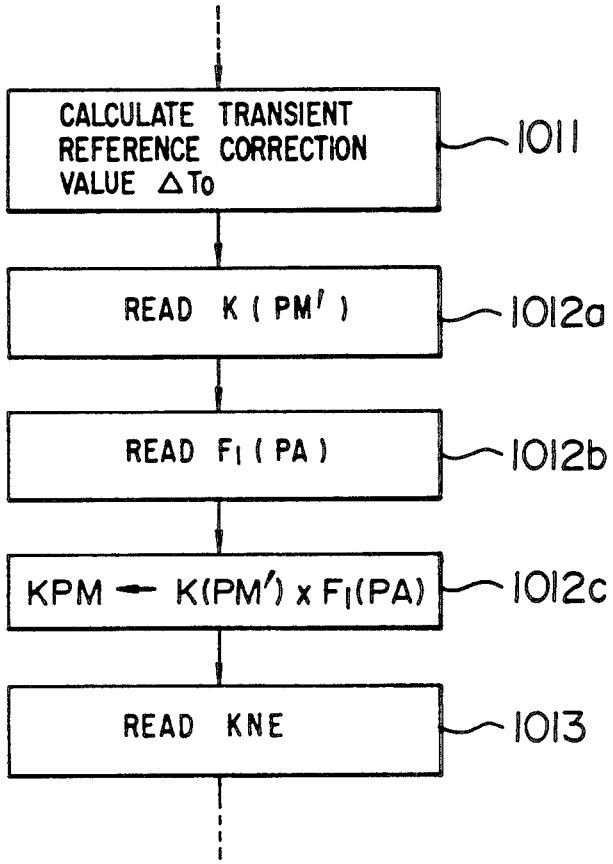
FIGS. 14 and 16 are flow charts for explaining the operation of other embodiments.

In the afore-mentioned embodiment, the load correction coefficients KPM are preliminarily stored in the ROM 108 so that the ROM forms a two-dimensional map of the intake air pressure PM and the atmospheric pressure PA, and the coefficient KPM is read from this two-dimensional map. However, the load correction coefficient KPM may be set as will be described below. Another embodiment of the setting of the load correction coefficient KPM will be described with reference to a flow chart shown in FIG. 14. A load correction reference coefficient K(PM') in accordance with a deviation between the atmospheric pressure PA and the intake air pressure PM is read at step 1012*a*. The characteristic of the load correction reference coefficient K(PM') corresponds to that of a given atmospheric pressure (for example, 760 mmHg in the present embodiment) among the characteristics shown in FIG. 10. The load correction reference coefficient K(PM') corresponding to the corrected intake air pressure PM' is read. Here, the corrected intake air pressure PM' is defined by the following formula:

$$PM'=PM+(760-PA)$$

The atmospheric pressure correction coefficient F1(PA) corresponding to the atmospheric pressure PA is then read at step 1012*b*.

Figure 15:
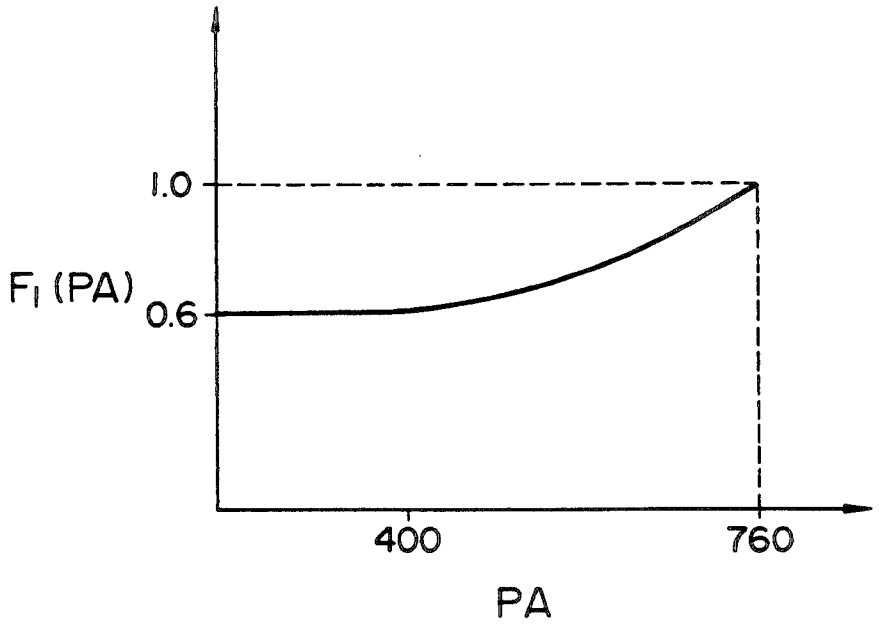

The atmospheric compensation coefficient F1(PA) has a characteristics shown in FIG. 15. The load correction coefficient KPM is set at step 1012*c* by the following formula:

$$KPM\leftarrow K(PM')\times F1(PA)$$

Figure 16:
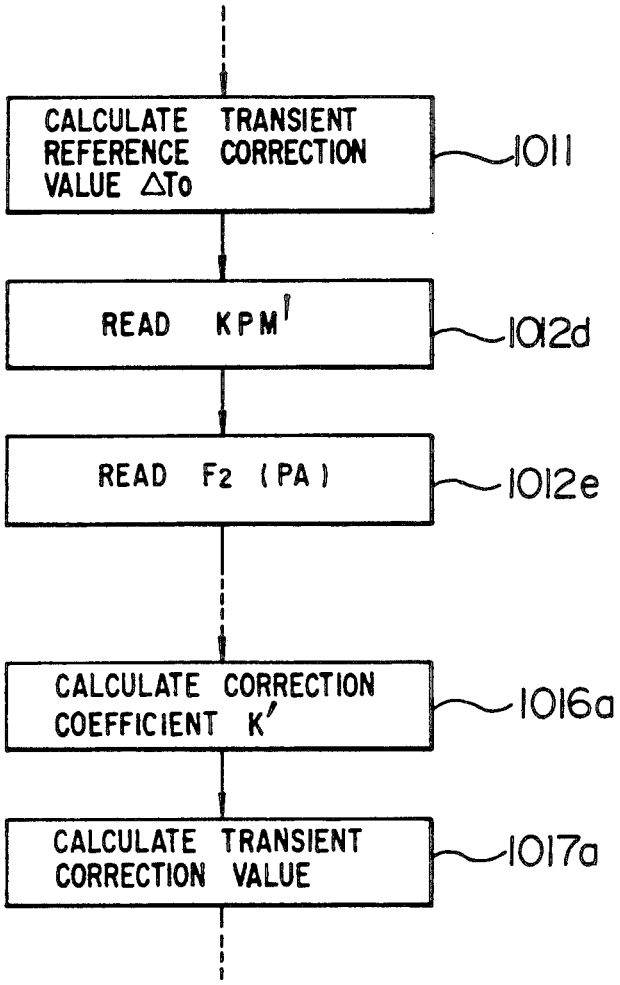
Figure 17:
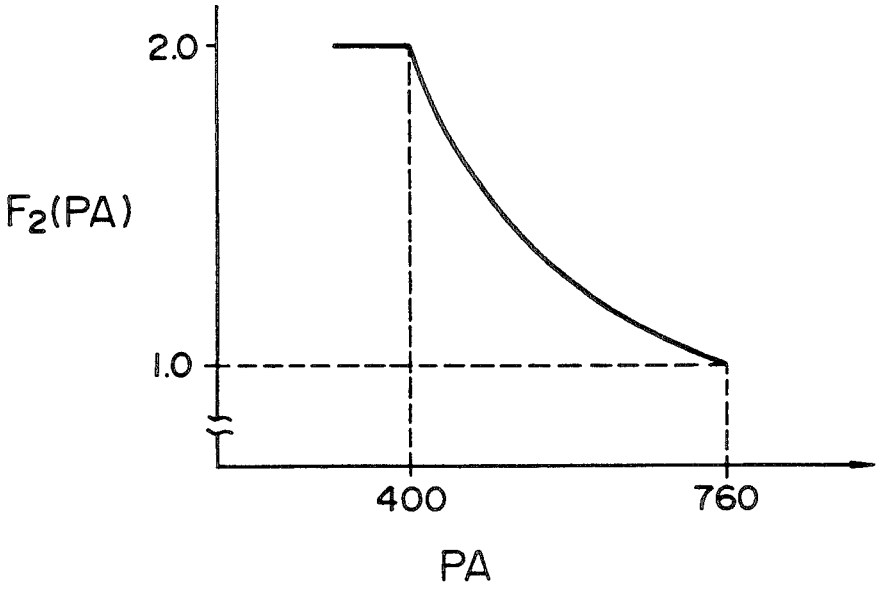

Alternatively, the transient correction value ΔT may be corrected by the atmospheric pressure PA. The atmosphere correction of the transient correction value ΔT will now be described with reference to a flow chart shown in FIG. 16. The load correction coefficient KPM' is read at step 1012*d*. The load correction coefficient KPM' corresponds to a given atmospheric pressure (for example, 760 mmHg in the present embodiment) and is determined in accordance with the intake air pressure PM. The atmospheric pressure correction coefficient F2(P2) corresponding to the atmospheric pressure PA is read at subsequent step 1012*e*. The atmospheric pressure correction coefficient F2(PA) has a characteristic as shown in FIG. 17. A description of steps 1013 through 1015 (not shown) is omitted, since they are identical with those of the above-mentioned embodiment. The correction coefficient K' is calculated at step 1016*a* by using the following formula:

$$K'=\{1+KPM'+KNE+KTHW+KTHQ\}$$

The transient correction value ΔT is calculated at the next step 1017*a* by the following formula:

$$\Delta T=C\times\Delta T_0\times K'\times F2(PA)$$

Figure 4:
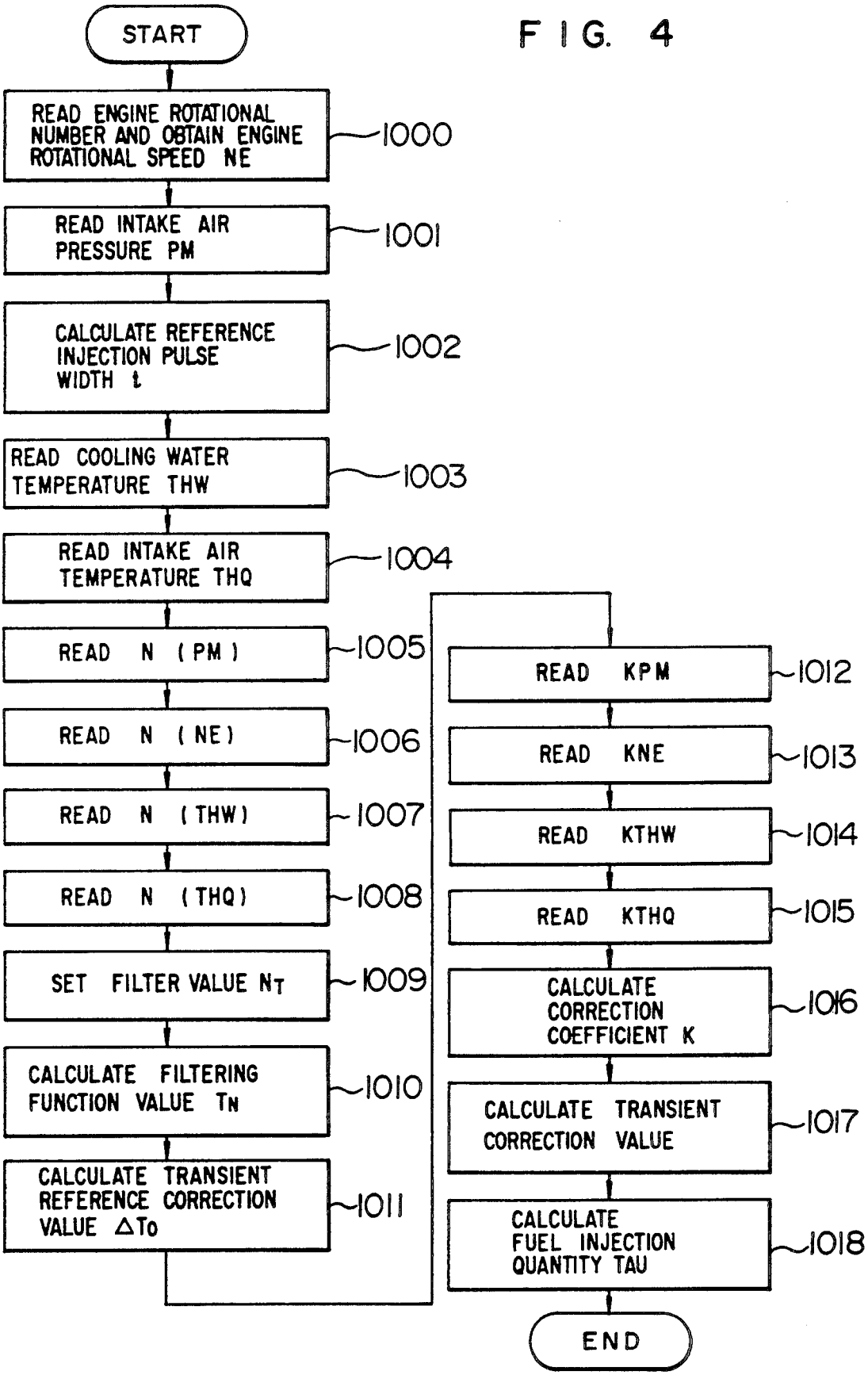
FIG. 4 is a flow chart for explaining the operation of the embodiment.

Thus, it is necessary to store the load correction coefficients KPM corresponding to various atmospheric pressures PA in ROM 108 in the embodiment shown in FIG. 4, which makes a large storage capacity necessary. However, in the embodiments shown in FIGS. 14 and 16, it will suffice to store a load reference correction coefficient K(PM') or a load correction coefficient KPM' at a given atmospheric pressure, and atmospheric pressure correction coefficients F1(PA) and F2(PA), thereby allowing the use of a smaller storage capacity.

Since the transient correction value, which is set in accordance with transient conditions, is corrected to be decreased as atmospheric pressure decreases in accordance with the present invention as has been described in detail hereinabove, an appropriate fuel injection quantity may be obtained in compliance with the mutual relation between the deposition and evaporation of fuel in an intake manifold, so that a deviation of air fuel ratio under a transient condition may be prevented, even when the atmospheric pressure varies.

What is claimed is:

1. A fuel injection control apparatus for controlling a quantity of fuel injected into an internal combustion engine comprising:

means for detecting atmospheric pressure;

means for detecting a load condition of an internal combustion engine including detecting an intake air pressure;

means for setting a reference fuel injection quantity in accordance with the load condition of said engine;

means for detecting a transient condition of said engine;

means for setting a transient correction value in accordance with the transient condition of said engine;

transient correction value correcting means for correcting the transient correction value based on the atmospheric pressure detected by said atmospheric pressure detecting means, and said intake air pressure detected by said load condition detecting means; and means for setting a quantity of injection fuel supplied to said engine in accordance with the set value of the reference fuel injection quantity and the corrected transient correction value.

2. A fuel injection control apparatus as defined in claim 1, wherein said transient condition detecting means includes:

filtering means for filtering the set value of the reference fuel injection quantity by using a given filter value to detect a filtering function value; and means for estimating the transient condition based on a deviation between the set value of the reference fuel injection quantity and the filtering function value.

3. A fuel injection control apparatus as defined in claim 2, wherein said filtering means includes filter value setting means for setting the given filter value in accordance with the load condition of said engine.

4. A fuel injection control apparatus as defined in claim 3, wherein said filter value setting means includes filter value correcting means which corrects the filter value to be increased with an increase in intake pipe pressure downstream of a throttle valve of said engine when the intake pipe pressure assumes a value smaller than a given value and corrects the filter value to be decreased with an increase in the intake pipe pressure when the above-said intake pipe pressure assumes a value not smaller than the given value.

5. A fuel injection control apparatus as defined in claim 1, wherein said transient correction value correcting means includes pressure correction means for correcting the transient correction value in accordance with the atmospheric pressure and intake pressure downstream of a throttle valve of said engine.

6. A fuel injection control apparatus as defined in claim 1, wherein said pressure correction means includes a first memory means for storing a pressure correction value in accordance with a pressure difference between the atmospheric pressure and the intake pipe pressure.

7. A fuel injection control apparatus as defined in claim 5, wherein said pressure correction means includes:

a second memory means for storing an intake pipe pressure correcting value in accordance with the intake pipe pressure; and a third memory means for storing an atmospheric pressure correction value which corrects the intake pipe pressure correcting value in accordance with the atmospheric pressure.

8. A fuel injection control apparatus for controlling a quantity of fuel injected into an internal combustion engine comprising:

means for detecting an operating condition of an internal combustion engine;

means for setting a reference fuel injection quantity in accordance with the operating condition of said engine;

means for setting a filter value in accordance with the operation condition of said engine;

filtering means for filtering the set value of the reference fuel injection quantity by using the filter value to detect a filtering function value;

means for setting a transient correction value based on a deviation between the set value of the reference fuel injection quantity and the filtering function value;

transient correction value correcting means for correcting the transient correction value in accordance with the operating condition of said engine; and means for setting a quantity of injection fuel TAU supplied to said engine in accordance with the set value of the reference fuel injection quantity and the corrected transient correction value.

9. A fuel injection control apparatus as defined in claim 8, wherein said transient correction value correcting means includes atmospheric correction means which corrects the transient correction value to be decreased with a decrease in atmospheric pressure.

10. A fuel injection control apparatus for controlling a quantity of fuel injected into an internal combustion engine comprising:

means for detecting atmospheric pressure;

means for detecting a load condition of an internal combustion engine including detecting an intake air pressure;

means for setting a reference fuel injection quantity in accordance with the load condition of said engine;

means for detecting a transient condition of said engine;

means for setting a transient correction value in accordance with the transient condition of said engine;

transient correction value correcting means for correcting the transient correction value based on the atmospheric pressure detected by said atmospheric pressure detecting means, and said intake air pressure detected by said load condition detecting means;

means for setting a quantity of injection fuel supplied to said engine in accordance with the set value of the reference fuel injection quantity and the corrected transient correction value; and a fuel injection valve disposed upstream of a throttle valve of said engine and injecting fuel of a quantity corresponding to the set injection fuel quantity.

* * * * *